US012433338B2

(12) United States Patent
Xu et al.

(10) Patent No.: US 12,433,338 B2
(45) Date of Patent: Oct. 7, 2025

(54) AEROSOL GENERATING DEVICE, CHARGING BASE, AND ELECTRIC SYSTEM

(71) Applicant: SHENZHEN FIRST UNION TECHNOLOGY CO., LTD., Shenzhen (CN)

(72) Inventors: Huanhong Xu, Shenzhen (CN); Supeng Kuai, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 381 days.

(21) Appl. No.: 17/753,130

(22) PCT Filed: Aug. 21, 2020

(86) PCT No.: PCT/CN2020/110591
§ 371 (c)(1),
(2) Date: Feb. 21, 2022

(87) PCT Pub. No.: WO2021/032200
PCT Pub. Date: Feb. 25, 2021

(65) Prior Publication Data

US 2022/0273038 A1 Sep. 1, 2022

(30) Foreign Application Priority Data

Aug. 21, 2019 (CN) ..... 201921360999.5
Aug. 21, 2019 (CN) ..... 201921361017.4

(51) Int. Cl.
*A24F 40/46* (2020.01)
*A24F 40/42* (2020.01)
(Continued)

(52) U.S. Cl.
CPC ..... *A24F 40/46* (2020.01); *A24F 40/42* (2020.01); *A24F 40/85* (2020.01); *A24F 40/90* (2020.01)

(58) Field of Classification Search
CPC ..... A24F 40/85; A24F 40/46; A24F 40/40; A24F 40/42
See application file for complete search history.

(56) References Cited

U.S. PATENT DOCUMENTS 9,936,735 B1 4/2018 Shotey et al.
2008/0314778 A1 12/2008 Hatton
(Continued)

FOREIGN PATENT DOCUMENTS

CN 206043444 U 3/2017
CN 108433188 A 8/2018
(Continued)

OTHER PUBLICATIONS

EPO Machine Translation of WO 2019214008A1 (published Nov. 14, 2019), accessed May 29, 2024. (Year: 2024).*
Machine Translation of CN108497559 (Year: 2024).*

*Primary Examiner* — Michael H. Wilson
*Assistant Examiner* — Jennifer A Kessie

(57) ABSTRACT

Provided are an aerosol generating device, a charging base, and an electric system. The aerosol generating device includes a first part, having a chamber configured for receiving a smokable material, and a heating element. The first part includes a gap, through which the heating element can be cleaned. In the direction of the cross section of the first part, connecting lines from the center of the heating element to two ends of the gap form an included angle of less than 90 degrees. A second part is removably connected to the first part, which is arranged to close or open the gap by being connected to the first part or removed from the first part. In
(Continued)

the open state, a user can extend a brush, scraper, etc. into the chamber by means of the gap to clean the heating element.

20 Claims, 7 Drawing Sheets

(51) Int. Cl.
*A24F 40/85* (2020.01)
*A24F 40/90* (2020.01)

(56) References Cited

U.S. PATENT DOCUMENTS

| | | | | |
|---|---|---|---|---|
| 2021/0093001 | A1* | 4/2021 | Phillips | A24F 40/42 |
| 2021/0093007 | A1* | 4/2021 | Fringeli | H05B 3/40 |
| 2022/0125109 | A1* | 4/2022 | Batista | A24F 40/53 |

FOREIGN PATENT DOCUMENTS

| | | | | |
|---|---|---|---|---|
| CN | 108497559 | A | 9/2018 | |
| CN | 108783605 | A | 11/2018 | |
| CN | 208425523 | U | 1/2019 | |
| CN | 211048399 | U | 7/2020 | |
| CN | 211065069 | U | 7/2020 | |
| JP | 3217554 | U | 8/2018 | |
| JP | 2019-506894 | A | 3/2019 | |
| KR | 20180070457 | A | 6/2018 | |
| WO | 2019030166 | A1 | 2/2019 | |
| WO | WO-2019121811 | A1 * | 6/2019 | A24F 40/20 |
| WO | WO-2019214008 | A1 * | 11/2019 | A24F 47/008 |

* cited by examiner

AEROSOL GENERATING DEVICE, CHARGING BASE, AND ELECTRIC SYSTEM

CROSS REFERENCE TO RELATED APPLICATION(S)

This application claims priorities to Chinese Patent Applications entitled "Aerosol generating device" with application number of 2019213610174, and entitled "Aerosol generating device, charging base, and electric system" with application number of 2019213609995, submitted to China National Intellectual Property Administration on Aug. 21, 2019, the entire contents of which are incorporated herein by reference.

TECHNICAL FIELD

The present disclosure relates to the field of heating non-burning smoking sets, and in particular to an aerosol generating device, a charging base, and an electric system.

BACKGROUND

Tobacco products (e.g., cigarettes, cigars, etc.) are burning tobaccos to produce tobacco smoke during use. People attempt to make products that release compounds without burning so as to replace the tobacco products burning tobaccos.

An example of this type of product is a heating device, which heats rather than burns a material to release compounds, for example, the material may be a tobacco product or other non-tobacco products which may contain or not contain nicotine. An example of this type of heating device includes a heating chamber configured for receiving a tobacco product, and a needle/pin like heating element arranged in the heating chamber; when a tobacco product is received into the heating chamber, the heating element can be inserted into the tobacco product to heat it to generate an aerosol.

During the use of this type of product, since the heating element is inserted into the tobacco product, the volatile ingredients in the tobacco product or the particle residues of the tobacco product are adhered to the surface of the heating element to thus affect the use. In view of this, a patent NO. 201820827370.6 of an existing technology provides a detachable heating device, which arranges a shell into two parts. When one part is detached, the heating element can be totally exposed, to ease the cleaning of the heating element. However, during implementation, this known approach lacks safety and protection measures when the heating element is totally exposed.

SUMMARY

In order to solve the problems of safety and protection in the cleaning process of the heating element in the heating device in existing technologies, the embodiment of the present disclosure provides an aerosol generating device which has a better safety protection during cleaning.

One embodiment of the present disclosure provides an aerosol generating device, which is configured for heating a smokable material so as to volatilize at least one ingredient of the smokable material, including:

a first part, including a chamber configured for receiving at least part of a smokable material, and a heating element arranged inside the chamber and capable of extending into the smokable material; the first part also including a gap extending in a length direction of the first part, through which one can reach the chamber to clean the heating element;

in the direction of the cross section of the first part, connecting lines from the center of the heating element to two ends of the gap forming an included angle less than 90 degrees; and a second part removably connected to the first part, which is arranged to close or open the gap by means of configuration between connected to the first part or removed from the first part.

Preferably, the second part includes a shielding wall, which is arranged to shield and close the gap when the second part is connected to the first part, or which is arranged to unshield and open the gap when the second part is removed from the first part.

Preferably, when the second part is connected to the first part, an external surface of the shielding wall is in flat joining with an external surface of the first part.

Preferably, the gap is arranged extending in a length direction of the first part; at least part of the extending length of the gap is overlapped with the extending length of the heating element inside the chamber.

Preferably, the second part can be connected to or removed from the first part roughly along the length direction of the first part.

Preferably, the first part includes an opening end opposite to the second part along the length direction, and the second part is removably connected to the opening end; and the gap extends to the opening end and is communicated with the opening end.

Preferably, the opening end presents an arc shape curved towards the gap.

Preferably, the gap is arranged on one of the side walls of the first part along a width direction.

Preferably, the heating element has an end part opposite to the opening end along the length direction, which has a distance greater than 10 mm to the opening end;

and/or, the heating element has a distance greater than 10 mm to the gap along the width direction;

and/or, the gap has a width between 6 and 15 mm;

and/or, in the direction of the cross section of the first part, connecting lines from the center of the heating element to two ends of the gap form an included angle between 25 and 70 degrees.

Preferably, the second part includes an inserting part which can be inserted into the opening end roughly along the length direction of the first part; and the inserting part is at least in part guided by an inner wall of the first part during the process of being inserted into the opening end.

Preferably, the second part includes a hole, through which the smokable material can be received into the chamber of the first part;

the second part further includes a moveable sliding cover, wherein the sliding cover includes a first position and a second position relative to the second part, and the sliding cover is arranged to open the hole when at the first position and to close the hole when at the second position;

the second part includes a first magnetic element and a second magnetic element that are arranged on two opposite sides of the hole along the sliding direction of the sliding cover; and the sliding cover includes a third magnetic element, which is arranged to attract the first magnetic element when at the first position and to attract the second magnetic element when at the second position.

Preferably, the second part includes a hole, through which the smokable material can be received into the chamber of the first part;

the second part further includes a moveable sliding cover, wherein the sliding cover includes a first position and a second position relative to the second part, and the sliding cover is arranged to open the hole when at the first position and to close the hole when at the second position; and the second part includes an accommodation space, and the sliding cover is at least in part accommodated in the accommodation space when at the second position.

Preferably, the sliding cover is further provided with a protruded contact part, by driving which the sliding cover can slide between the first position and the second position.

The first part of the aerosol generating device is provided with a gap used for cleaning, and in the open state, a user can extend a brush, scraper, etc. into the chamber by means of the gap to clean the heating element; furthermore, when the gap is opened, at most partial of the heating element is exposed by means of the gap, rather than the entire heating element being exposed to the exterior, thus safety is improved.

One embodiment of the present disclosure further provides an electric system, including the aerosol generating device above, and a charging base configured for charging the aerosol generating device.

Preferably, the charging base includes an abutting part extending along a length direction, and a supporting part extending from the abutting part along a width direction, wherein the abutting part and the supporting part define an accommodation chamber that is located on one side of the charging base along the width direction;

the aerosol generating device is removably received into the accommodation chamber, and when the aerosol generating device is received into the accommodation chamber, the aerosol generating device is held on the supporting part and abuts against the abutting part.

Preferably, the aerosol generating device includes a first charging interface;

the charging base includes a first connector, and when the aerosol generating device is received into the accommodation chamber, the first charging interface is in electrical connection with the first connector, in order to charge the aerosol generating device.

Preferably, the aerosol generating device includes a second charging interface; and when the aerosol generating device is received into the accommodation chamber, the second charging interface is shielded by the charging base.

Preferably, the aerosol generating device includes a first adhesive member, the charging base includes a second adhesive member, and when the aerosol generating device is received into the accommodation chamber, the first adhesive member and the second adhesive member are arranged to be opposite to each other.

Preferably, the charging base roughly presents an L shape.

Preferably, the abutting part includes a side wall opposite to the accommodation chamber along the width direction;

the first charging interface is arranged on the side wall, and the second charging interface is arranged on an end part of the aerosol generating device opposite to the supporting part along the length direction;

and/or, the side wall is inward concave along the width direction.

One embodiment of the present disclosure further provides a charging base matched with the aerosol generating device, which is configured for charging the aerosol generating device, wherein the charging base includes an abutting part extending along a length direction, and a supporting part extending from the abutting part along a width direction, wherein the abutting part and the supporting part define an accommodation chamber that is located on one side of the charging base along the width direction and is configured for receiving the aerosol generating device; and when the aerosol generating device is received into the accommodation chamber, the aerosol generating device is held on the supporting part and abuts against the abutting part.

Preferably, the charging base includes a first connector, and when the aerosol generating device is received into the accommodation chamber, the first connector is in electrical connection with the aerosol generating device, in order to charge the aerosol generating device.

One embodiment of the present disclosure further provides an aerosol generating device matched with the charging base, which is configured for heating a smokable material so as to volatilize at least one ingredient of the smokable material; wherein the charging base includes an abutting part extending along a length direction, and a supporting part extending along a width direction, wherein the abutting part and the supporting part define an accommodation chamber that is located on one side of the charging base along the width direction; the aerosol generating device is removably received into the accommodation chamber; and when the aerosol generating device is received into the accommodation chamber, the aerosol generating device is held on the supporting part and abuts against the abutting part.

Preferably, the aerosol generating device includes a first charging interface and a second charging interface; when the aerosol generating device is received into the accommodation chamber, the first charging interface is in electrical connection with the charging base, so as to charge the aerosol generating device, and the second charging interface is shielded by the charging base.

With the above electric system, the aerosol generating device is received onto the charging base through the accommodation chamber opened on one side to get charged; during usage, even if the charging base does not include a separate cover and the like opening-closing structure, the aerosol generating device can also be fixedly inserted into the charging base.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

DETAILED DESCRIPTION

For a better understanding of the present disclosure, the present disclosure is described below in further detail in conjunction with accompanying drawings and specific embodiments.

One embodiment of the present disclosure provides an aerosol generating device, which is configured for receiving and heating a smokable material to volatilize at least one ingredient of the smokable material, so as to generate a vapor or aerosol for a user to inhale. Generally, the vapor is a substance in gas phase at a temperature below its critical temperature, which means, for example, the vapor can be condensed into a liquid in the condition of increasing the pressure without decreasing the temperature. In another aspect, generally, the aerosol is a colloid of fine solid particles or droplets in air or another gas. The colloid is a substance in which microscopic, disperse and insoluble particles suspend in another substance.

The smokable material preferably includes a tobacco-containing material that releases volatile tobacco-flavoring compounds when heated. Of course, the smokable material also includes an aerosol forming substances that can form an aerosol, examples of a proper aerosol forming substance are glycerol and propylene glycol. In preferred embodiments, the smokable material presents a column shape, containing powders, fine particles, pellets, fragments, solid strips, strips, or sheets of one or more of herbal leaves, tobacco leaves, tobacco strips, reconstituted tobacco, homogeneous tobacco, extruded tobacco and expanded tobacco.

Figure 1:
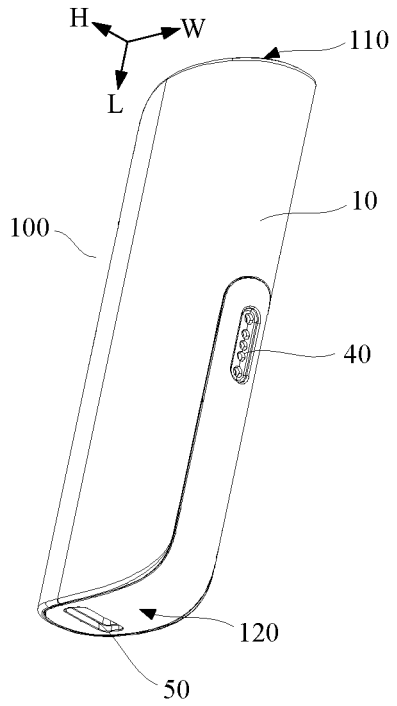
FIG. 1 is a structure diagram of an aerosol generating device according to one embodiment from one perspective.
Figure 2:
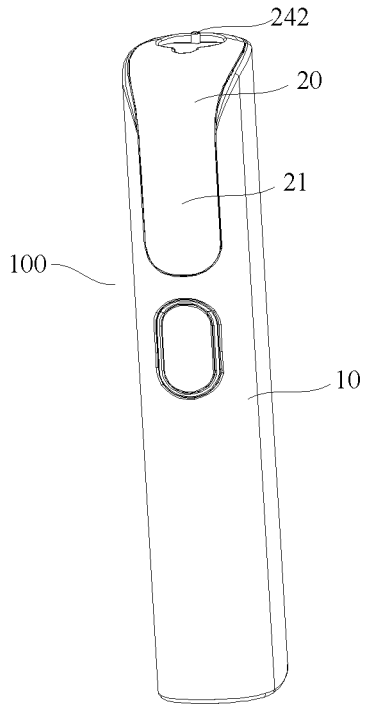
FIG. 2 is a structure diagram of the aerosol generating device shown in FIG. 1 from another perspective.
Figure 3:
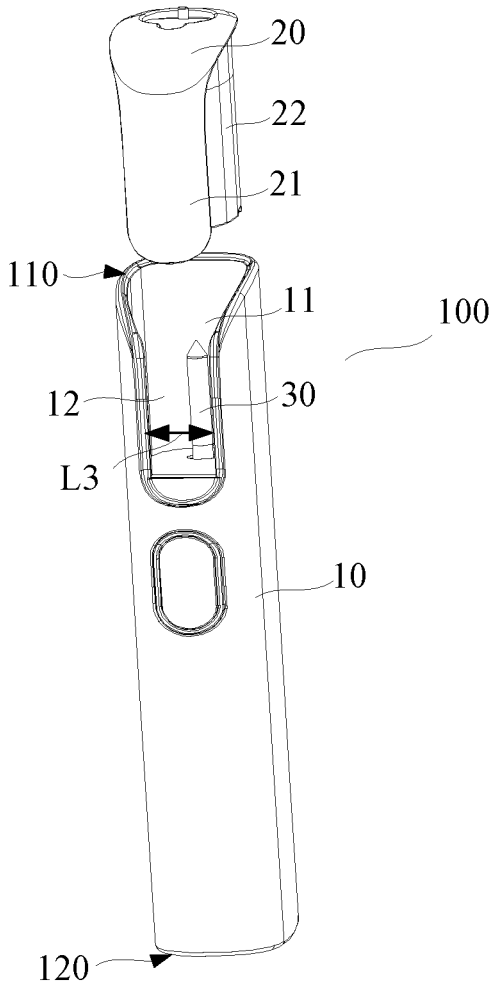
FIG. 3 is a diagram of the aerosol generating device shown in FIG. 2 from which a second part is removed.

In one embodiment of the present disclosure, an appearance structure of the aerosol generating device 100 can refer to what shown in FIG. 1 to FIG. 3, which roughly presents a tabular shape, that is, the size along the length direction L is greater than that along the width direction W and that along the thickness direction H; and the functional structure includes:

a first part 10, and a second part 20 which is removably connected to the first part 10 through a connection structure, wherein the connection structure, for example, may be a snap connecting piece/thread connecting piece, etc.

Further, the first part 10 defines a chamber 11 therein and has a heating element 30 arranged inside the chamber 11; a smokable material A may be at least in part received into the chamber 11; the heating element 30 presents a needle/pin shape, which is configured for being inserted into the smokable material A to heat the smokable material A.

Figure 7:
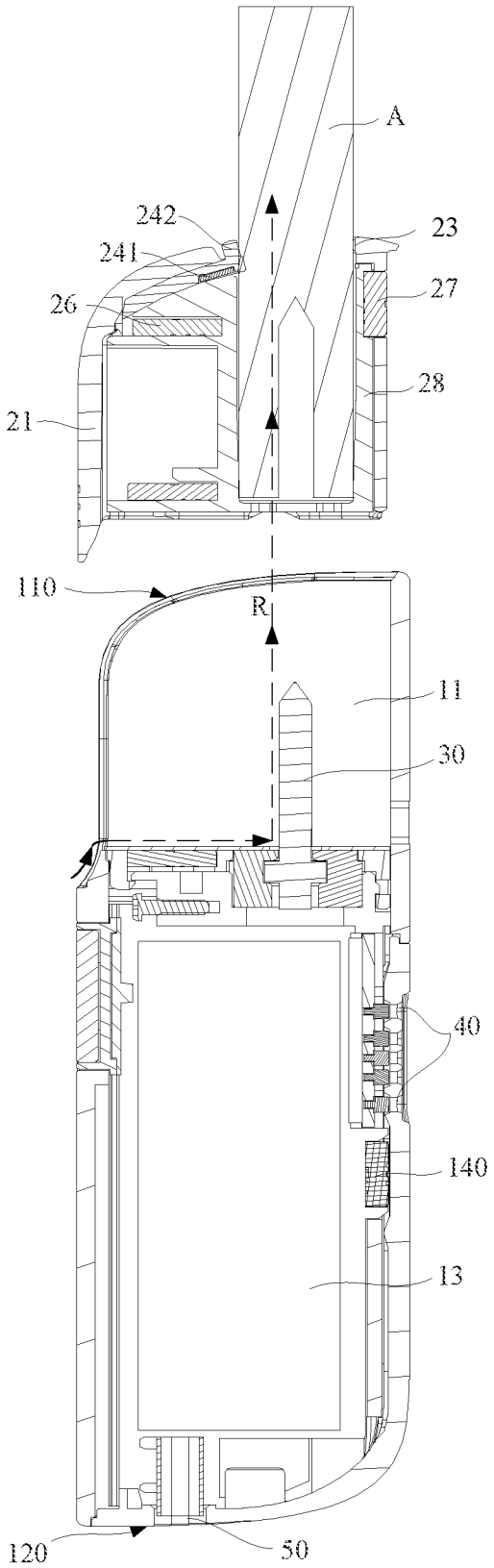
FIG. 7 is a diagram of the aerosol generating device shown in FIG. 6 from which a second part is removed.

According to the product form of the smokable material A, in the embodiment shown in FIG. 7, the smokable material A may be similar to a traditional burning type cigarette. For example, the smokable material A may include a first section containing an aerosol generating material and a second section containing a filter tip, etc. In the implementation of FIG. 7, the first section is entirely or at least in part inserted into the chamber 11, and the second section may be exposed to the exterior. A user can inhale an aerosol through keeping between lips the second section exposed to the exterior.

In one embodiment, as shown in FIG. 3, the first part 10 defines a gap 12 thereon, through which a user can extend into the chamber 11 to clean the heating element 30. Moreover, from the figure it can be seen that the gap 12 is defined to be opposite to at most partial of the heating element 30, thus at most partial of the heating element 30, rather than the entire heating element 30, can be exposed through the gap 12. The second part 20 is arranged to close or open the gap 12 through being removably connected or removed from the first part 20.

Figure 4:
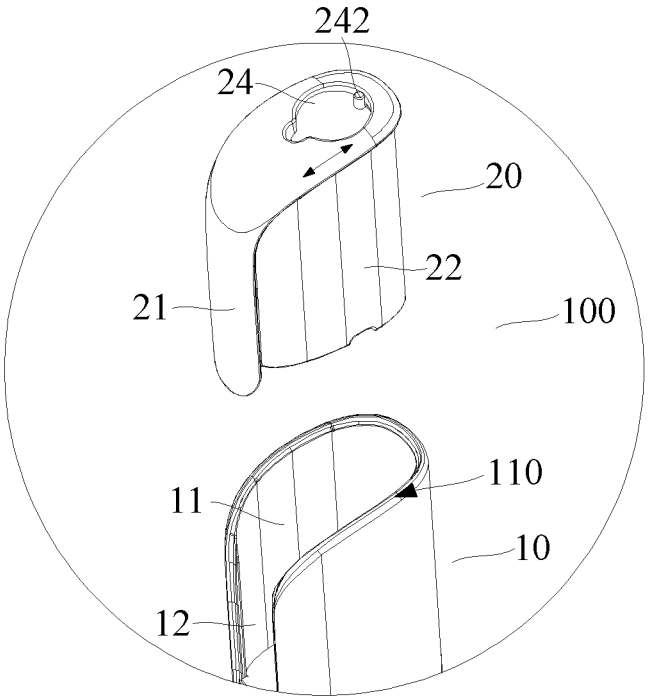
FIG. 4 is a diagram of what shown in FIG. 3 from which a second part is removed from another perspective.

According to embodiments shown in FIG. 3 and FIG. 4, the gap 12 is defined on one side wall along the width direction W, and the gap 12 extends to communicate with an opening structure of a proximal end 110; the proximal end 110 presents a smooth arc shape gradually inclined towards the gap 12, so as to increase the operation space of brush, scraper, etc. during the cleaning process.

Further, as shown in FIG. 3, the gap 12 extends along the length direction, and at least part of the extending length covers the extending length of the heating element 30 located inside the chamber 11, or at least part of the extending length is overlapped with the extending length of the heating element 30 located inside the chamber 11.

The first part 10 of the aerosol generating device 100 in the above embodiment is provided with a gap 12 used for cleaning, and in the open state, a user can extend a brush, scraper, etc. into the chamber 11 by means of the gap 12 to clean the heating element 30; moreover, the heating element 30 is not exposed to the exterior, thus safety is improved.

In FIG. 2 and FIG. 3, the second part 20 includes a shielding wall 21, which is arranged in the gap 12 to shield and close the gap 12 when the second part 20 is connected to the first part 10; moreover, an external surface of the shielding wall 21 is in flat joining with an external surface of the first part 10, to form a smooth appearance.

In another embodiment, referring to FIG. 3 and FIG. 4, to facilitate the removing and connecting operation between the first part 10 and the second part 20, the first part 10 includes a proximal end 110 and a distal end 120 that are opposite to each other along the length direction L, wherein the proximal end 110 is an opening structure. The second part 20 includes an inserting part 22, which is arranged to at least partially pass through the proximal end 110 along the length direction of the first part 10 to be received and connected into the first part 10 in an inserting manner. Moreover, the outer wall of the inserting part 22 is adapted to the inner wall of the first part 10 in shape and size, so that the inserting part 22 is at least in part guided by the inner wall of the first part 10 during the inserting or removing process, thereby enabling stable and smooth removing and inserting processes.

Figure 6:
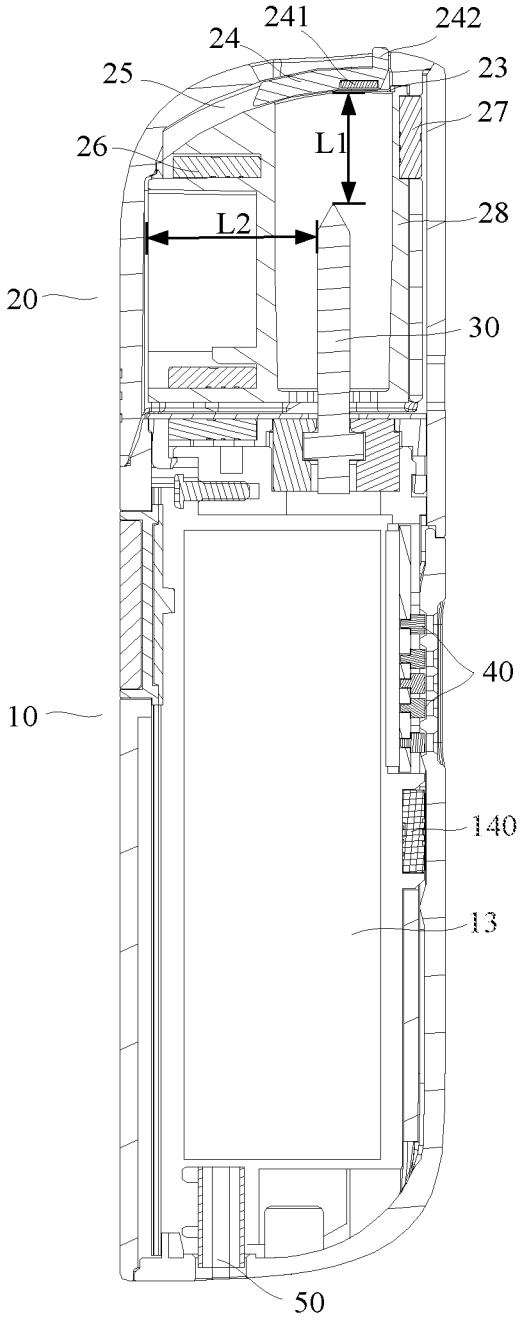
FIG. 6 is a sectional view of the aerosol generating device shown in FIG. 1 along a length direction.

According to an optimal safety and operation design, referring to FIG. 3 and FIG. 6, along the length direction L, an upper end part of the heating element 30 has a distance L1 to the proximal end 110, and along the width direction W, the heating element 30 has a distance L2 to the gap 12, wherein both L1 and L2 are greater than 10 mm. The width size L3 of the gap 12 along the thickness direction H is controlled to be about 6-15 mm.

Figure 5:
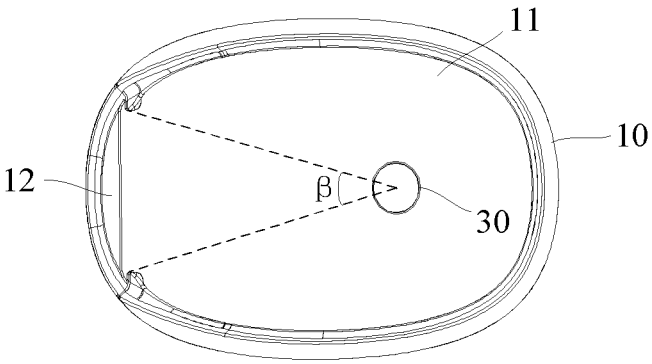
FIG. 5 is a top view of a first part of the aerosol generating device shown in FIG. 1.

Moreover, according to the requirements of cleaning and safety protection in implementation, referring to FIG. 5, which shows a top view of the first part 10; from the figure it can be seen that connecting lines from two ends of the width of the gap 12 to the center of the heating element 30 form an included angle β, which is controlled to be less than 90 degrees during implementation; in FIG. 5 the included angle β preferably is controlled to be between 25 and 70 degrees.

In one embodiment, the heating element 30 is a resistance-type heating element, for example, the heating element 30 may include a conductive trace, and when a current flows through the conductive trace, the heating element 30 may be heated. For stable use, an electric energy can be supplied to the heating element 30 in a standard condition of, but not limited to, 3.2V, 2.4 A and 8 W. For example, when an electric energy is supplied to the heating element 30, the surface temperature of the heating element 30 can increase to 300 centigrade degrees or higher. The surface temperature of the heating element 30 can increase to about 320 centigrade degrees within 15 seconds after the electric energy is supplied to the heating element 30. The heating element 30 may be connected to a first battery cell 13 arranged inside the first part 10 through a lead, a pin, a terminal and the like, so as to generate heat under the power supply of the first battery cell 13 to heat the smokable material A.

In another embodiment, referring to FIG. 6 and FIG. 7, the second part 20 defines a hole 23 thereon; when the second part 20 is connected to the first part 10, the smokable material A can be removably received into the chamber 11 through the hole 23. Meanwhile, the second part 20 is provided with a sliding cover 24 configured for opening or closing the hole 23, wherein the sliding cover 24 is moveably arranged on the second part 20, and has a first position and a second position relative to the second part 20, as shown in FIG. 6 and FIG. 7 respectively; when at the first position as shown in FIG. 7, the sliding cover 24 opens the hole 23, and when at the second position as shown in FIG. 6, the sliding cover 24 shields or closes the hole 23. Moreover, when at the second position, the sliding cover 24 is at least in part accommodated in the second part 20. Specifically, as shown in FIG. 6, the second part 20 includes an accommodation part 25 extending along the movement direction of the sliding cover 24, and the sliding cover 24, when at the second position, is at least in part accommodated in the accommodation part 25 without exposure; when at the first position, the sliding cover 24 is removed from the accommodation part 25 and exposed to the exterior.

According to embodiments shown in FIG. 6 and FIG. 7, the second part 20 further includes a first magnetic element 26 and a second magnetic element 27 that are arranged on two sides of the hole along the sliding direction of the sliding cover 24; the sliding cover 24 is provided with a third magnetic element 241, which is arranged to attract the first magnetic element 26 when at the first position and to attract the second magnetic element 27 when at the second position, such that the sliding cover 24 can be held stably when at the first position and the second position.

Meanwhile, as shown in the figures, the sliding cover 24 is further provided with a protruded contact part 242, to which a user can apply an external force to drive the sliding cover 24 to slide between the first position and the second position and thus change the state configuration.

Based on the requirements to improve the easiness of receiving and removing the smokable material A, the second part 20 is further provided with a tubular extractor 28 that is communicated with the hole 23; when the second part 20 is connected to the first part 10, the extractor 28 is inserted into the chamber 11 of the first part 10, and the inner space of the extractor 28 forms a holding space for holding the smokable material A. The heating element 30 passes through the smokable material A held in the extractor 28 to heat the smokable material A. When the second part 20 is removed from the first part 10, the second part 20 keeps the smokable material A held in the extractor 28.

During the smoking process, a path direction R of the airflow is as shown in FIG. 7, specifically, the air enters the chamber 11 from the slit between the gap 12 of the first part 10 and the second part 20, reaches nearby the heating element 30 and then enters the extractor 28 from an air inlet (not shown) on the bottom of the extractor 28, and finally passes through the smokable material A to be inhaled at the top end.

Further, as shown in FIG. 1, FIG. 6 and FIG. 7, one side wall of the first part 10 of the aerosol generating device 100 along the width direction defines a first interface 40, and the distal end 120 defines a second interface 50; wherein the first interface 40 and the second interface 50 are both in electrical connection with the first battery cell 13 in the first part 10, so as to charge the first battery cell 13. According to the product form shown in FIG. 1, the first interface 40 employs a 5P type charging interface, and the second interface 50 employs a USB Type-C charging interface. Of course, the above first interface 40 and second interface 50 can also change to other types of interfaces with similar charging functions. From the figure the first interface 40 is arranged on another side wall opposite to the gap 12 along the width direction W.

Figure 8:
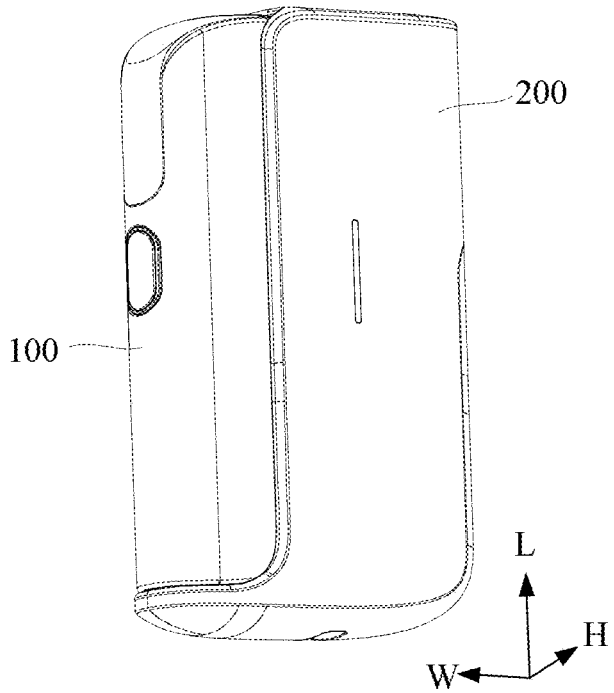
FIG. 8 is a diagram of a charging base matched with an aerosol generating device according to one embodiment.

Based on the implementation of products, one embodiment of the present disclosure further provides a charging base 200 matched with the above aerosol generating device. In one embodiment, the structure can refer to FIG. 8 to FIG. 10. The overall structure roughly presents an L shape, including an abutting part 200*a* extending along a length direction L and a supporting part 200*b* extending along a width direction W, which define an accommodation chamber 210 that extends towards one side and is configured for receiving and holding the above aerosol generating device 100. Further, from the figure it can be seen the accommodation chamber 210 is located external to the charging base 200; therefore, during usage, even if the charging base 200 does not include a separate cover and the like opening-closing structure, the aerosol generating device 100 can also be fixedly inserted into the charging base 200.

Meanwhile, when the charging base 200 of the above structure is used in conjunction with the aerosol generating device 100, the aerosol generating device 100, received in the accommodation chamber 210, is supported by the supporting part 200*b* and abuts against the abutting part 200*a* to realize fixing.

Figure 9:
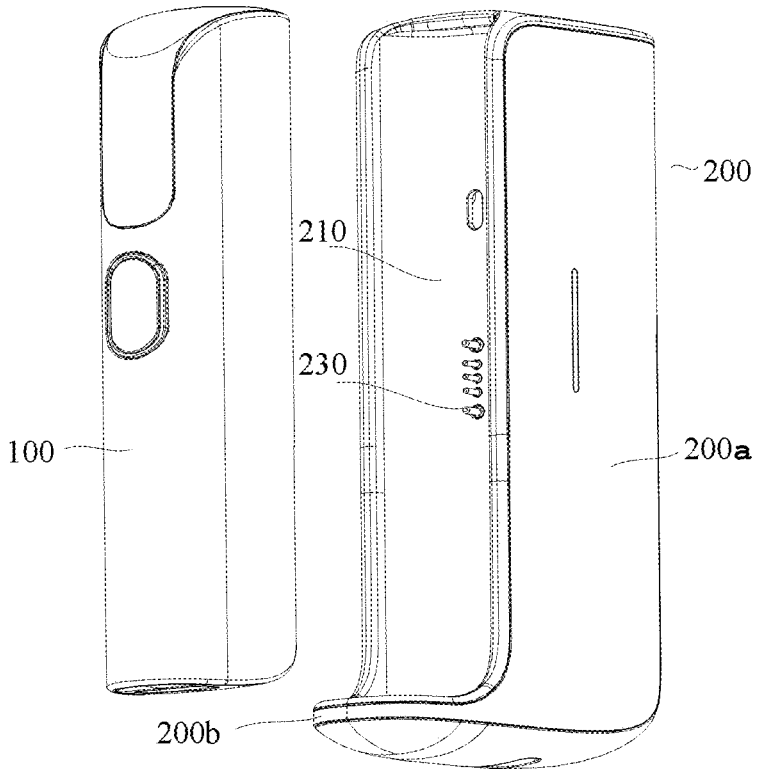
FIG. 9 is a diagram of the charging base shown in FIG. 8 from which an aerosol generating device is split.

Moreover, as shown in FIG. 9, a side wall of the abutting part 200*a* opposite to the accommodation chamber 210 along the width direction is arranged inward concave, thus when the aerosol generating device 100 is received in the accommodation chamber 210, matched with the inward concave side wall of the abutting part 200*a*, the stability of fit can be improved.

Meanwhile, according to a further optimal effect of product design, the accommodation chamber 210 is adapted to the aerosol generating device 100 in shape; when received in the accommodation chamber 210, the aerosol generating device 100 can form a regular block shape with the charging base 200; moreover, the external surface of the aerosol generating device 100 is in flat joining with the external surface of the charging base 200.

According to functional structures, the charging base 200 includes a second battery cell 220, and a third interface 230 in adapted connection with the first interface 40, for example, five micro pins adapted to the 5P type first interface 40 as shown in FIG. 9; when the aerosol generating device 100 is received in the accommodation chamber 210 of the charging base 200, the first battery cell 13 of the aerosol generating device 100 can be charged by the electric energy supplied by the second battery cell 200 of the charging base 200.

Furthermore, when the aerosol generating device 100 is connected to the charging base 200, the second battery cell 220 can supply an electric energy for operating the aerosol generating device 100. For example, when the aerosol generating device 100 is connected to the charging base 200, the aerosol generating device 100 can be operated through directly using the electric energy supplied by the second battery cell 220 of the charging base 200, no matter whether the first battery cell 13 of the aerosol generating device 100 discharges or not. For example, when the aerosol generating device 100 is connected to the charging base 200, the electric energy of the second battery cell 220 can be supplied to the aerosol generating device 100 to charge the first battery cell 13 or to heat the heating element 30. Moreover, after they are connected, the charging base 200 does not shield the hole 23 on the second part 20 of the aerosol generating device 100 configured for receiving the smokable material A; therefore, even if the remaining capacity of the first battery cell 13 is very low, a user can still smoke continuously by connecting the aerosol generating device 100 to the charging base 200.

Based on use safety, when the aerosol generating device 100 is connected to the charging base 200, the charging base 200 covers the second interface 50 on the distal end 120 of the aerosol generating device 100, such that the second interface 50 cannot be connected to a charging line and other accessories to be charged, which avoids the occurrence that the first interface 40 and the second interface 50 of the aerosol generating device 100 are in a charging state at the same time to cause a safety problem.

Figure 10:
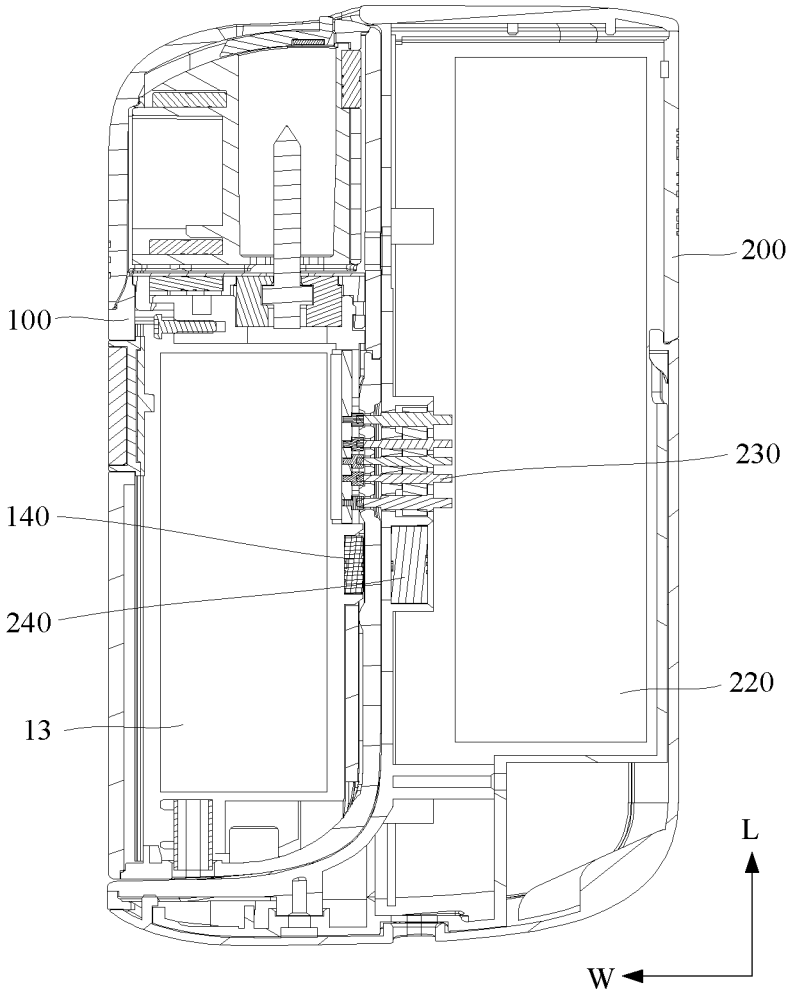
FIG. 10 is a sectional view of the charging base shown in FIG. 8 to which an aerosol generating device is connected.

To assist the connection between the aerosol generating device 100 and the charging base 200, an auxiliary structure includes at least one adhesive member for increasing the adhesive force between the charging base 200 and the aerosol generating device 100; specifically, for example, the aerosol generating device 100 is provided with at least one first adhesive member 140, the charging base 200 is provided with at least one second adhesive member 240. The first adhesive member 140 and the second adhesive member 240 may be, but not limited to, a magnet. Moreover, as to the positions to arrange the adhesive members, the aerosol generating device 100 can include the first adhesive member 140 on a third position, and the charging base 200 can include the second adhesive member 240 on a fourth position, as shown in FIG. 10. In this condition, when the aerosol generating device 100 is connected to the charging base 200, the third position and the fourth position may be opposite to each other. Since the aerosol generating device 100 and the charging base 200 include the above adhesive members, thus when the aerosol generating device 100 is connected to the charging base 200, the aerosol generating device 100 and the charging base 200 can be connected to each other more firmly.

It is to be noted that the description and the accompanying drawings of the present disclosure just illustrate some preferred embodiments of the present disclosure, but are not limited to the embodiments described in the description; further, for the ordinary staff in the art, improvements or transformations can be made according to the above description, and these improvements and transformations are intended to be included in the scope of protection of claims appended hereinafter.

The invention claimed is:

1. An aerosol generating device, which is configured for heating a smokable material so as to volatilize at least one ingredient of the smokable material, comprising:

a first part having a length in a length direction, and comprising a chamber configured for receiving at least part of a smokable material, and a heating element arranged inside the chamber and extending in the length direction of the first part; the first part also comprising a gap extending in the length direction of the first part, through which one can reach the chamber to clean the heating element; wherein a cross section of the first part perpendicular to the length direction and passing through the gap has a width in a width direction and a thickness in a thickness direction, wherein the width is longer than the thickness, wherein along the width direction, a first distance between the heating element and the gap is greater than a second distance between the heating element and a chamber wall that is opposite to the gap, wherein the cross section and the first distance provide that the heating element is asymmetrically arranged within the chamber, wherein the heating element has a distance greater than 10 mm to the gap along the width direction, wherein in the direction of the cross section of the first part, connecting lines from the center of the heating element to two ends of the gap forming an included angle less than 90 degrees; and a second part removably connected to the first part through a connection structure, wherein the second part is arranged to close or open the gap.

2. The aerosol generating device according to claim 1, wherein the second part comprises a shielding wall, which is arranged to shield and close the gap when the second part is connected to the first part, or which is arranged to unshield and open the gap when the second part is removed from the first part.

3. The aerosol generating device according to claim 2, wherein when the second part is connected to the first part, an external surface of the shielding wall is in flat joining with an external surface of the first part.

4. The aerosol generating device according to claim 1, wherein at least part of the extending length of the gap is overlapped with the extending length of the heating element inside the chamber.

5. The aerosol generating device according to claim 1, wherein the second part can be connected to or removed from the first part along the length direction of the first part.

6. The aerosol generating device according to claim 1, wherein the first part comprises an opening end opposite to the second part along the length direction, and the second part is removably connected to the opening end; and the gap extends to the opening end and is communicated with the opening end.

7. The aerosol generating device according to claim 6, wherein the opening end presents an arc shape curved towards the gap.

8. The aerosol generating device according to claim 6, wherein the gap is arranged on one of the side walls of the first part along the width direction.

9. The aerosol generating device according to claim 8, wherein the heating element has an end part opposite to the opening end along the length direction, which has a distance greater than 10 mm to the opening end;

and/or, the gap has a width between 6 and 15 mm;

and/or, in the direction of the cross section of the first part, connecting lines from the center of the heating element to two ends of the gap form an included angle between 25 and 70 degrees.

10. The aerosol generating device according to claim 6, wherein the second part comprises an inserting part which can be inserted into the opening end along the length direction of the first part; and the inserting part is at least in part guided by an inner wall of the first part during the process of being inserted into the opening end.

11. The aerosol generating device according to claim 1, wherein the second part comprises a hole, through which the smokable material can be received into the chamber of the first part;

the second part further comprises a moveable sliding cover, wherein the sliding cover comprises a first position and a second position relative to the second part, and the sliding cover is arranged to open the hole when at the first position and to close the hole when at the second position;

the second part comprises a first magnetic element and a second magnetic element that are arranged on two opposite sides of the hole along the sliding direction of the sliding cover; and the sliding cover comprises a third magnetic element, which is arranged to attract the first magnetic element when at the first position and to attract the second magnetic element when at the second position.

12. The aerosol generating device according to claim 1, wherein the second part comprises a hole, through which the smokable material can be received into the chamber of the first part;

the second part further comprises a moveable sliding cover, wherein the sliding cover comprises a first position and a second position relative to the second part, and the sliding cover is arranged to open the hole when at the first position and to close the hole when at the second position; and the second part comprises an accommodation space, and the sliding cover is at least in part accommodated in the accommodation space when at the second position.

13. The aerosol generating device according to claim 11, wherein the sliding cover is further provided with a protruded contact part, by driving which the sliding cover can slide between the first position and the second position.

14. An electric system, comprising the aerosol generating device according to claim 1, and a charging base configured for charging the aerosol generating device.

15. The electric system according to claim 14, wherein the charging base comprises an abutting part extending along a length direction, and a supporting part extending from the abutting part along a width direction, wherein the abutting part and the supporting part define an accommodation chamber that is located on one side of the charging base along the width direction;

the aerosol generating device is removably received into the accommodation chamber, and when the aerosol generating device is received into the accommodation chamber, the aerosol generating device is held on the supporting part and abuts against the abutting part.

16. The electric system according to claim 15, wherein the aerosol generating device comprises a first charging interface; the charging base comprises a first connector, and when the aerosol generating device is received into the accommodation chamber, the first charging interface is in electrical connection with the first connector, in order to charge the aerosol generating device.

17. The electric system according to claim 16, wherein the aerosol generating device further comprises a second charging interface; and when the aerosol generating device is received into the accommodation chamber, the second charging interface is shielded by the charging base.

18. The electric system according to claim 15, wherein the aerosol generating device comprises a first adhesive member, the charging base comprises a second adhesive member, and when the aerosol generating device is received into the accommodation chamber, the first adhesive member and the second adhesive member are arranged to be opposite to each other.

19. The electric system according to claim 15, wherein the charging base roughly presents an L shape.

20. The electric system according to claim 17, wherein the abutting part comprises a side wall opposite to the accommodation chamber along the width direction;

the first charging interface is arranged on the side wall, and the second charging interface is arranged on an end part of the aerosol generating device opposite to the supporting part along the length direction;

and/or, the side wall is inward concave along the width direction.

* * * * *